US011292008B2

(12) United States Patent
Beliavsky

(10) Patent No.: US 11,292,008 B2
(45) Date of Patent: Apr. 5, 2022

(54) VORTEX MILL AND METHOD OF VORTEX MILLING FOR OBTAINING POWDER WITH CUSTOMIZABLE PARTICLE SIZE DISTRIBUTION

(71) Applicant: SUPER FINE LTD., Lower Galilee (IL)

(72) Inventor: Yan Beliavsky, Maalot (IL)

(73) Assignee: SUPER FINE LTD., Lower Galilee (IL)

( * ) Notice: Subject to any disclaimer, the term of this patent is extended or adjusted under 35 U.S.C. 154(b) by 496 days.

(21) Appl. No.: 15/838,384

(22) Filed: Dec. 12, 2017

(65) Prior Publication Data

US 2019/0176161 A1 Jun. 13, 2019

(51) Int. Cl.
*B02C 19/06* (2006.01)
*B02C 25/00* (2006.01)

(52) U.S. Cl.
CPC ..... *B02C 19/061* (2013.01); *B02C 25/00* (2013.01)

(58) Field of Classification Search
CPC ..... B02C 19/06; B02C 19/061; B02C 19/068; B02C 19/063
(Continued)

(56) References Cited

U.S. PATENT DOCUMENTS 4,219,164 A * 8/1980 Taylor ..... B02C 19/061 241/5
5,855,326 A 1/1999 Beliavsky
(Continued)

FOREIGN PATENT DOCUMENTS

RU 2057588 C1 4/1996
SU 1457995 A1 2/1989
(Continued)

*Primary Examiner* — Debra M Sullivan
*Assistant Examiner* — Matthew Stephens
(74) *Attorney, Agent, or Firm* — Soroker-Agmon-Nordman; Sharone Godesh

(57) ABSTRACT

A vortex mill and a milling method for comminuting of a raw particulate material is described. The vortex mill comprises an outer preferably cylindrical casing fitted with an inlet port for supplying a compressed working fluid into the easing. The vortex mill further comprises a milling chamber, which is situated in the casing. The milling chamber is configured for comminuting the particulate solids therein. The milling chamber is delimited by a side wall, by a lower disc and by an opposite upper disc.

A central opening is provided in the upper disc and at least one nozzle is arranged in the side wall of the milling chamber such that a compressed working fluid could be supplied from the outer casing trough the at least one nozzle tangentially into the milling chamber.

The vortex mill further comprises a discharge collector, which is in fluid communication with the milling chamber via the central opening in the upper disc wall.

A feeding tube is provided which is situated co-axially with the milling chamber and is in fluid communication therewith so as to supply the raw particulate material into the milling chamber.

The vortex mill further comprises at least one comminuting control component enabling comminuting the raw material such that material with customizable parameters of particle size distribution is produced.

5 Claims, 14 Drawing Sheets

(58) Field of Classification Search
USPC ..... 241/5, 39
See application file for complete search history.

(56) References Cited

U.S. PATENT DOCUMENTS

| | | | | |
|---|---|---|---|---|
| 6,789,756 | B2 * | 9/2004 | Beliavsky | B02C 19/061 241/5 |
| 2014/0138462 | A1 * | 5/2014 | Lustig | C01B 35/023 241/5 |

FOREIGN PATENT DOCUMENTS

| | | | |
|---|---|---|---|
| WO | 94/08719 | A1 | 4/1994 |
| WO | 98/52694 | A1 | 11/1998 |

* cited by examiner

Analysis

Malvern Instruments

Malvern

| Measurement Details | |
|---|---|
| Sample Name | n.1 13 03 17 |
| SOP File Name | Hydro2V.cfg |
| File Name | Dolomite |
| Record Number | 76 |
| Sample Source | Wet |

| Measurement Details | |
|---|---|
| Analysis Date Time | 3/13/2017 2:02:48 PM |
| Measurement Date Time | 3/13/2017 2:02:48 PM |
| Result Source | Measurement |
| Post measurement Instructions | 2000 rpm, ok 20%, 3min |
| Air Pressure Demand | |
| Feed Rate Achieved | |

| Analysis | |
|---|---|
| Particle Name | Dolomite |
| Particle Refractive Index | 1.592 |
| Particle Absorption Index | 0.010 |
| Dispersant Name | Water |
| Dispersant Refractive Index | 1.330 |
| Scattering Model | Mie |
| Analysis Model | General Purpose |
| Weighted Residual | 2.03 % |
| Laser Obscuration | 9.80 % |

| Result | |
|---|---|
| Span | 1.438 |
| Uniformity | 0.438 |
| Specific Surface Area | 2077 $m^2/kg$ |
| D [4,3] | 4.00 µm |
| Dv (10) | 1.58 µm |
| Dv (50) | 3.71 µm |
| Dv (90) | 6.89 µm |
| Dv (99) | 9.32 µm |
| Dv (100) | 11.2 µm |
| Volume Below (10) µm | 92.94 % |

Frequency (compatible)

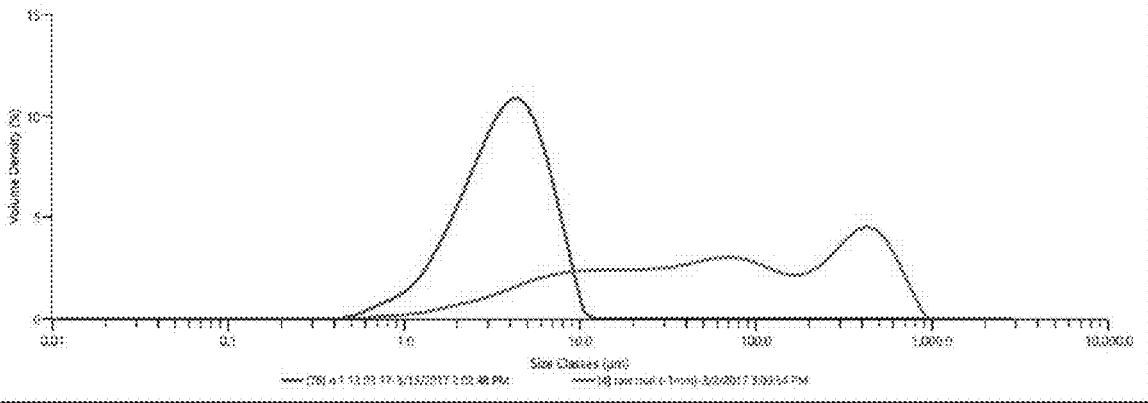

Result

| Size (µm) | % Volume Under | Size (µm) | % Volume Under | Size (µm) | % Volume Under | Size (µm) | % Volume Under | Size (µm) | % Volume Under | Size (µm) | % Volume Under | Size (µm) | % Volume Under | Size (µm) | % Volume Under |
|---|---|---|---|---|---|---|---|---|---|---|---|---|---|---|---|
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |

Malvern

Malvern Instruments Ltd.

www.malvern.com

Mastersizer - v3.30

Page 1 of 1

Dolomite

Created: 8/9/2016

Printed: 7/18/2017 2:00 PM

FIGURE 1

VORTEX MILL AND METHOD OF VORTEX MILLING FOR OBTAINING POWDER WITH CUSTOMIZABLE PARTICLE SIZE DISTRIBUTION

FIELD OF THE INVENTION

The present invention relates to comminution of particulate solid materials. In the further disclosure the term comminution as well as terms milling, grinding, disintegration, fragmentation, pulverizing, abrasion, wear, breaking, crushing are used. It should be borne in mind that the above-mentioned terms would be considered here as synonyms and their meaning within the present disclosure is reducing particle size of a non-consolidated solid material.

More particularly the present invention refers to a milling process known in the art as vortex milling. In this process so-called whirl or vortex mills are employed. The vortex mills are provided with a vortex milling chamber in which to be comminuted material is continuously charged and in which a tornado-like condition is created, resulting in applying aerodynamic force to the material so as to efficiently break its particles in their weakest points.

The vortex milling process and vortex mills can be used for reducing particle size of a variety of materials, for example organic or inorganic materials, chemicals, minerals, ceramic materials, metals, etc.

BACKGROUND OF THE INVENTION

Among advantages of vortex mills one can mention the absence of moving parts, consuming admissible amounts of energy and possibility of operating in a continuous mode resulting in obtaining comminuted powder with homogeneously (uniformly) sized particles.

Further advantage is associated with the fact that vortex milling is energetically saving. There are two reasons for this advantage: a) vortex milling does not require high pressure to achieve the supercritical velocity of the particles during jet milling process; and b) due to the high degree of uniformity of the vortex layer it is possible to obtain the same degree of milling at a higher feeding rate of the raw material to be milled.

At the same time there are known in the art plenty designs of vortex mills, which have been devised in continuing attempts to achieve better control of the quality of milling in terms of achievable uniformity of particle size distribution, achievable minimal particle size and achievable specific surface area.

Today one of the commonly acceptable means for quantitative assessing the above mentioned parameters is analysis of laser beam diffraction on the particles of the powder and it is commonly acceptable practice to define the parameters of the comminuted powder with the aim of this technique. These parameters are determined by virtue of the graph presenting the volume (mass) particle size distribution (PSD graph), obtained as a result of the powder analysis.

Among the above mentioned parameters of particle size distribution one can mention:

1. d(10)—the particle dimension (micron), which refers to the fine fraction of the powder.—Its significance is that amount of particles with dimension less than d(10) is 10% of the powder mass;
2. d(50)—the particle dimension (micron), which is an "average" parameter. Its significance is that amount of particles with dimension more or less than d(50) is 50% of the powder mass;

3. d(90)—the particle dimension (micron), which significance is that amount of particles with dimension less than d(90) is 90% of the powder mass;
4. d(100) or so-called "top cut"—the particle dimension (micron), which significance is that in the powder are absent particles with dimension more than d(100).

In FIG. 1 there are shown two graphs representing particle size distributions of raw dolomite particles before comminution and after comminution. The data was obtained with the Particle size analyzer Mastersizer 3000 manufactured by Malvern Instruments Company.

With the aim of this graph the above mentioned parameters cap be derived and today this is commonly acceptable industrial standard used for quantitative quality assessment of the comminuted powder.

The large amount of known in the art contractions of vortex mills as well as of methods of their operation reflect the never ended attempts to improve control of those parameters so as to make possible customizing of the PSD graph.

In FIGS. 2, 2*a* and 2*b* is shown construction of a known in the art vortex mill described in WO 94/08719, WO 98/52694.

In U.S. Pat. No. 5,855,326 is disclosed a process of controlled comminution of a particulate solid material having particles of predetermined dimensions, and also a milling whirl chamber having two opposite end disks and a cylindrical side wall with at least one nozzle for injection a working fluid into the chamber. The chamber is provided with means for introducing the particulate solid material therein, a central axial passage for discharge of the comminuted material in a flow of the working fluid from the chamber, and one or more mechanical elements for control of the comminution process in the chamber. The process includes tangential injection of the working fluid in to the chamber, introducing the particulate solid material for creating in the chamber a vortex where the particulate material undergoes comminution in the flow of the working fluid, and control of uniformity of the milling and dimensions of the particles therein by deliberately accelerating or retarding discharge from the chamber of the particles moving in the vortex close to the inner walls of the chamber by the mechanical elements provided in the chamber and adapted to interact with such particles.

In U.S. Pat. No. 6,789,756 is described vortex mill, which includes one or more working chambers. The mill also includes one or more working fluid inlets and one or more discharge ports for discharging the comminuted powder.

In addition, there is provided apparatus for inducing controlled perturbations in the flow of the working fluid in the one or more working chambers, thereby to improve the milling qualify of the solid material in the vortex flow.

In SU1457995 is described method of disintegration of dispersed materials is a vortex mill which working chamber is provided with opposite bait walls configured with hyperbolic profile. The working chamber is provided with a feed well in which slanted slits are made for tangential directing material flow charged within the working chamber. The working chamber is provided also with rotatable porous cylindrical wall through which the charged flow can penetrate. Particles of the charged material undergo energetically efficient grinding, when direction of rotation of the porous wall is opposite to the tangentially directed material flow.

In RU2057588 is described method of vortex grinding as well as vortex grinding mill for its implementation. The vortex mill is provided with cylindrical feed chamber, through which solid loosed material is fed into working chamber. The working chamber is defined by opposite upper and lower cover and by cylindrical periphery wall. The periphery wall is provided with inlet port for admitting flow medium into the working chamber and with outlet port for discharge the comminuted material. The working chamber is fitted with a profiled insert located within the chamber. The insert is provided with tangential slits for directing the flow medium entering through the inlet port and for directing exiting suspension of comminuted material. The upper cover of the working chamber is provided with exit opening through which suspension of the comminuted material is discharged from the working chamber in the feed chamber.

It is reported that by virtue of discharging the comminuted material through exit port made in the peripheral wall and through exit opening made in the upper cover and by virtue of configuration and certain relationship between their surfaces it is possible to achieve comminuted material with uniform properties.

Except of purely constructional measures employed for control of the vortex process some other measures are also known, which have been used in an attempt to improve quality control of the comminuted powder.

Among those measures one can mention applying of variable pressure within interior of the vortex milling chamber.

So, for example in the article New version of a vortex mill, presented at The Third Israeli Conference for Conveying and Handling of Particulate-Solids Joined with the Tenth International Freight Pipeline Society Symposium Dead Sea, Israel May 2000, pp. 6.6-6.11 is discussed influence of the following conditions on behavior of solids particles in vortex mill:

a) Arranging of rapid serial pressure changes within the milling chamber (so-called Resonance milling process), and
b) Applying of multiple gentle impacts to the particles inside vortex milling chamber.

In particular it is reported that by virtue of particles collisions with the inner surface of the milling chamber and with other particles they undergo multiple gentle impacts applied to the particles. By virtue of this provision plurality of micro-cracks is developed within the colliding particles. By virtue of the rapid serial pressure changes there are established oscillations of particle fragments. The oscillations prevent healing of the cracks, amplify cluster of micro-cracks, and eventually the particles break down.

Thus it can be seen that despite vortex milling technology is known for decades there still is felt a strong need in devising a new and improved vortex mill as well as of a new and improved methods of vortex milling, which would allow efficient comminution control.

OBJECT OF THE INVENTION

Accordingly the main object of the present invention is to provide new and improved vortex mill and method of vortex milling, which enable obtaining of comminuted powder with custom made quantitative particle size distribution characteristics, i.e. characteristics which can be set before comminution depending on the requirements to fee comminuted powder.

The further object of the invention is to provide new and improved vortex mill and method of vortex milling, which enable obtaining of comminuted powder with custom made quantitative particle size distribution characteristics, varying within narrow limits.

Still further object of the present invention it is to provide new and improved vortex mill and method of vortex milling, which enable obtaining of comminuted powder with custom made quantitative particle size distribution characteristics, which we obtained by analysis of diffraction caused by laser beam on the powder particles.

Another object of the invention is to provide new and improved vortex mill and method of vortex milling, which enable obtaining of comminuted powder with custom made quantitative particle size distribution characteristics comprising d(10), d(50), d(90) d(99) and d(100) parameters.

SUMMARY OF THE INVENTION

In the further description of the present invention, terms such as "top", "bottom", "upper", "lower", "height" and "side" are utilized for convenience of description and are not necessarily intended to indicate an orientation in space.

The present invention in its various embodiments can be implemented as a new vortex mill and as a method for vortex milling.

When the invention is implemented as a vortex mill it comprises an outer casing fitted with an inlet port for supplying a compressed working thud into the casing, said vortex mill further comprising a milling chamber, which is situated in the casing, said milling chamber is configured for comminuting a particulate solids therein, said milling chamber being delimited by a preferably cylindrical side wall, by a lower disc wall and by an opposite upper disc wall, said milling chamber has a diameter D, wherein a central opening is provided in the upper disc wall, said central opening has a diameter d and at least one nozzle is arranged in the side wall of the milling chamber such that a compressed working fluid could be supplied from the outer casing trough the at least one nozzle tangentially into the milling chamber. Said vortex mill can be manufactured without of said outer casing, in this instance the compressed working fluid is supplied through the said at least one inlet port directly to the said at least one nozzle. The vortex mill further comprises a discharge collector, which is in fluid communication with the milling chamber via the central opening in the upper disc wall, and a feeding tube is provided which is situated co-axially with the milling chamber and is in fluid communication therewith so as to supply the raw particulate material into the milling chamber, wherein said diameter d of the central opening in the upper disc is dimensioned so as to allow passing the comminuted material from the milling chamber into the discharge collector, wherein said vortex mill further comprises at least one comminuting control component enabling obtaining comminuted material with custom made parameters of particle size distribution.

When the invention is implemented in one of the numerous embodiments as a method it comprises for example the following main steps:

a) supplying of a flow of compressed working fluid to the milling chamber, said flow being directed tangentially with respect to a side wall of the milling chamber, said flow creates inside said milling chamber the vortex flow having radial component of velocity directed from said side wall to the center.
b) supplying of an additional flow of compressed fluid, said additional flow being directed radially towards the side wall of the milling chamber aid opposite to the radial component of the main flow of working fluid, wherein the flow rate of the additional flow does not exceed 16% of the flow rate of the tangentially directed flow of working fluid.

BRIEF DESCRIPTION OF THE DRAWINGS

The above invention will be further described and illustrated with reference to the appended non-limiting drawings, in which:

FIG. 1 is an example of graphical representation of particle size distribution parameters of a comminuted powder.

FIG. 3 a is a top cross-sectional view of the vortex mill shown in FIG. 3.

DETAILED DESCRIPTION OF THE PREFERRED EMBODIMENTS

Figure 2:
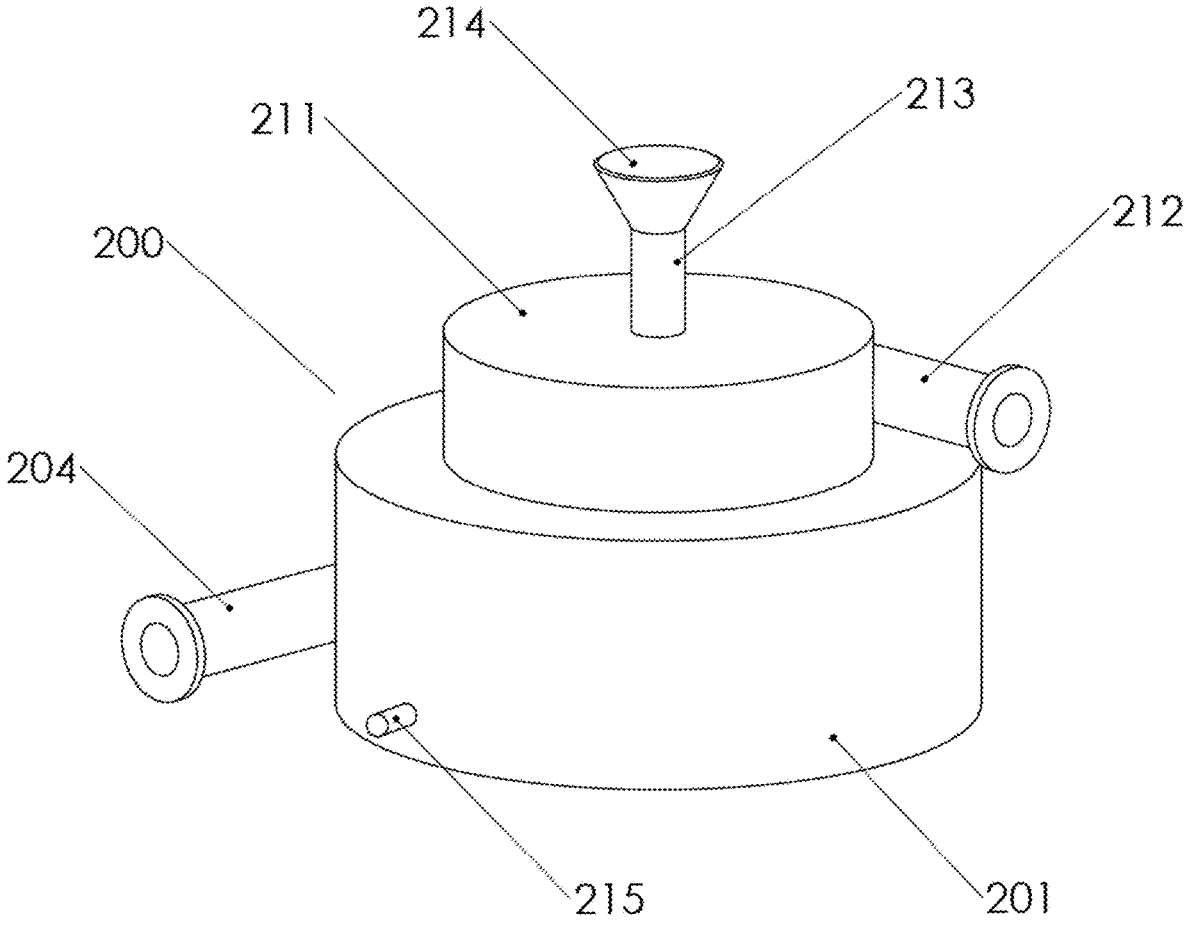
FIG. 2 is an isometric view of a known in the art vortex mill.
Figure 2A:
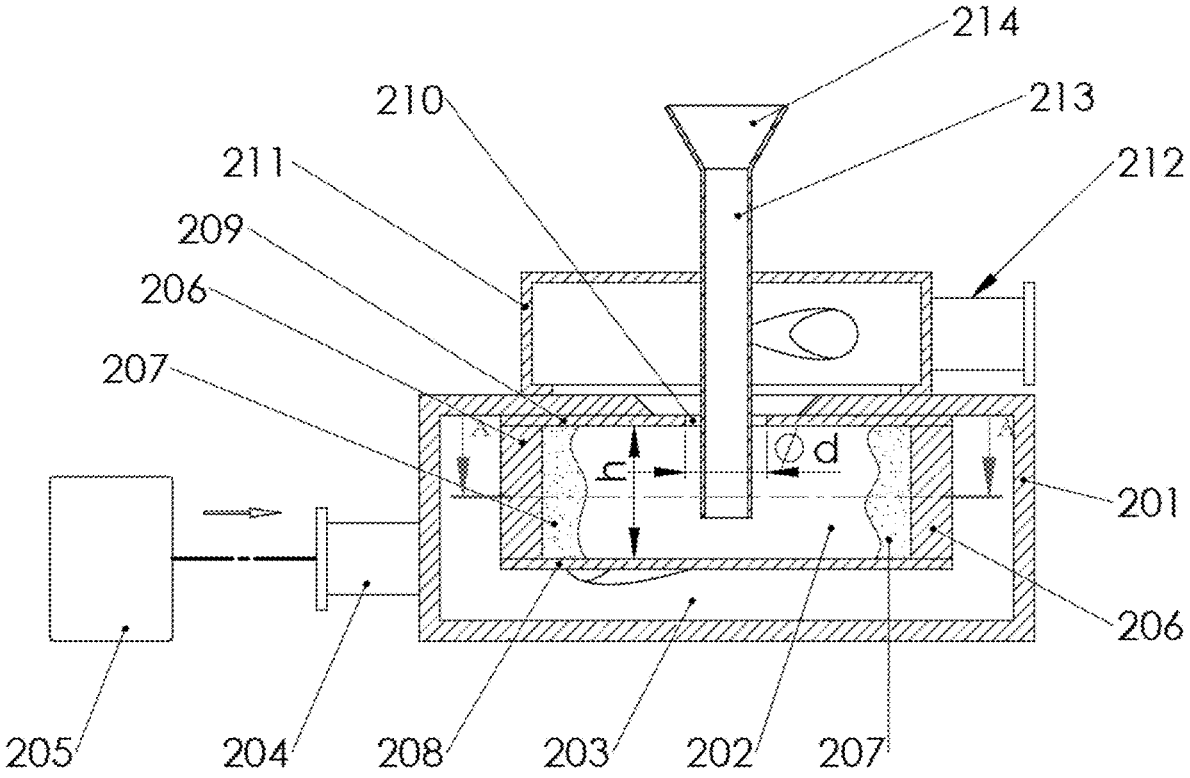
FIG. 2*a* is a frontal cross-sectional view of the vortex mill shown in FIG. 2.
Figure 2B:
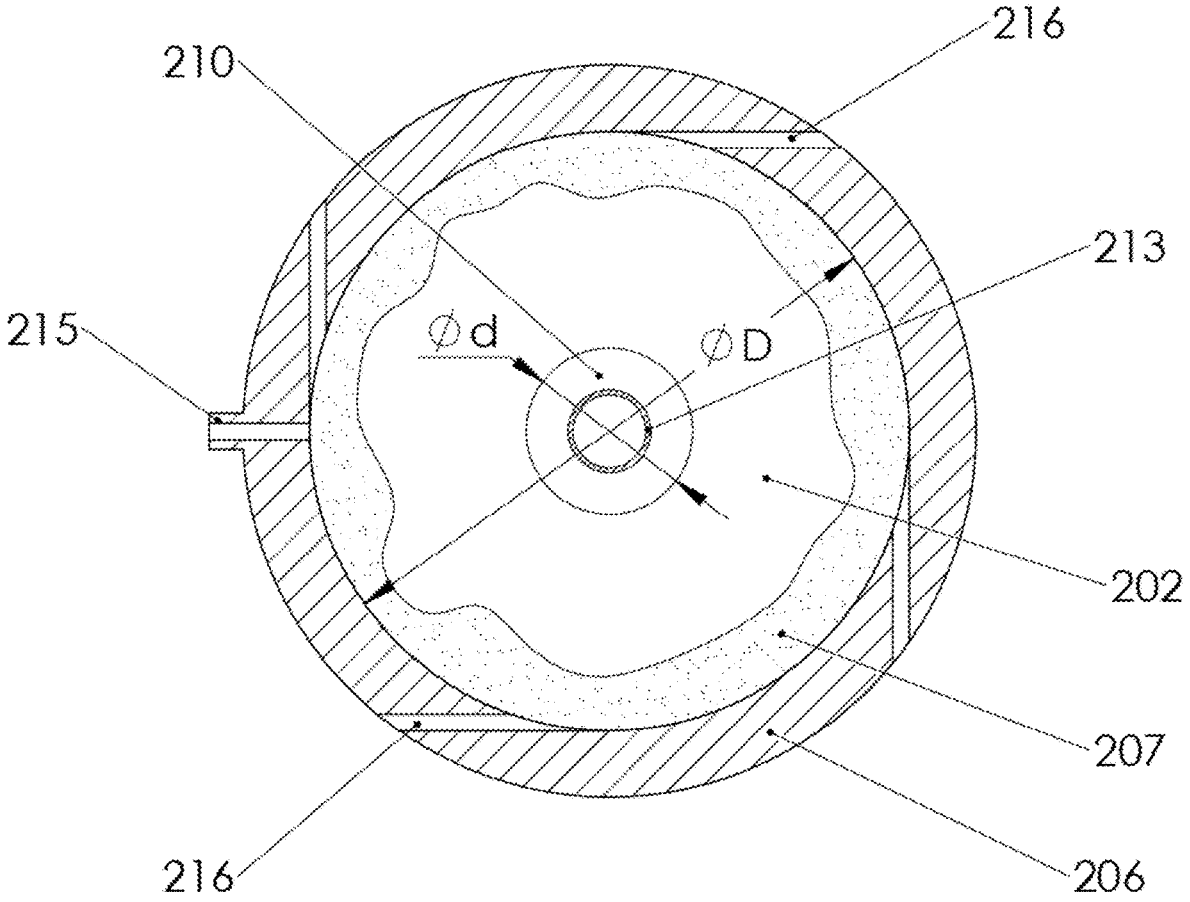
FIG. 2*b* is a top cross-sectional view of the vortex mill shown in FIG. 2.

Referring now to FIGS. 2, 2*a* and 2*b* it is seen a vortex mill 200, having an outer, easing 201 in which a vortex milling chamber 202 is located. The outer casing 201 is configured preferably as a cylinder, which dimensions are selected such that a volume 203 is provided between the casing and the milling chamber.

At least one working fluid inlet 204 is arranged on the outer casing 201 such that a compressed working fluid can be supplied from a source of compressed working fluid 205 to the volume 203.

In practice a compressed gas, (e.g. air, nitrogen, water steam or an inert gas) is used as a working fluid, depending on the material to be comminuted.

The vortex milling chamber is delimited by a side (periphery) cylindrical wall 206 on which a vortex layer 207 of comminuting particles is accumulated. The particles are suspended in the field of centrifugal forces in said working fluid during operation of the mill.

The milling chamber is further delimited by a lower disc 208 and by an upper disc 209, which in fact are opposite flat walls of the vortex milling chamber 202. These elements will be referred-to in the further disclosure also either as upper or lower disc or as upper or lower disc wall.

The interior of the milling chamber is defined by a diameter D and a height dimension h, which is a distance between the flat elements 208 and 209.

A central opening 210 having a diameter d is provided in the upper disc 209, which function will be explained further.

A discharge collector 211 is provided which is arranged on the casing and is in fluid communication with the milling chamber through the central opening 210.

The discharge collector has a lateral wall, in which an outlet port 212 is made through which the comminuted powder can be discharged from the discharge collector.

A feeding tube 213 passing co-axially with the milling chamber through the discharge collector is provided. This tube has a diameter which is less than d, such that the tube can pass through the central opening 210 in the upper disc 209 so as to allow fluid communication with interior of the milling chamber 202 via lower open end of the feeding tube 213. A funnel 214 is provided at an upper end of the tube for feeding raw particulate solids into the milling chamber via the feeding tube 213.

As seen in FIG. 2*b* the cylindrical wall 206 of the vortex milling chamber 202 is provided with a side discharge port 215 and with a plurality of nozzles 216, which are directed tangentially with respect to the cylindrical wall of the milling chamber. The compressed fluid from the volume 203 entering through the tangentially directed nozzles 216 into the milling chamber 202 creates therein a tornado-like condition, resulting in applying aerodynamic force to particles of the raw particulate solids and eventually brings to their disintegration. During operation of the mill the raw particulate solid is continuously fed into the milling chamber 202 via the feeding tube 213, where the comminuting takes place. The comminuted powder passes through the central opening 210 from the milling chamber into discharge collector 211 and can be evacuated from the discharge collector via the outlet port 212.

Having briefly explained the principle of operation of the known in the art vortex mill the embodiments of the present invention will be now disclosed. The common idea employed in the further disclosed embodiments is retrofitting the prior art vortex mill with a new component, which allows efficient control of the comminuting process and obtaining the comminuted powder having either predictable or predefined, i.e. customized characteristics of its particle size distribution.

Figure 3:
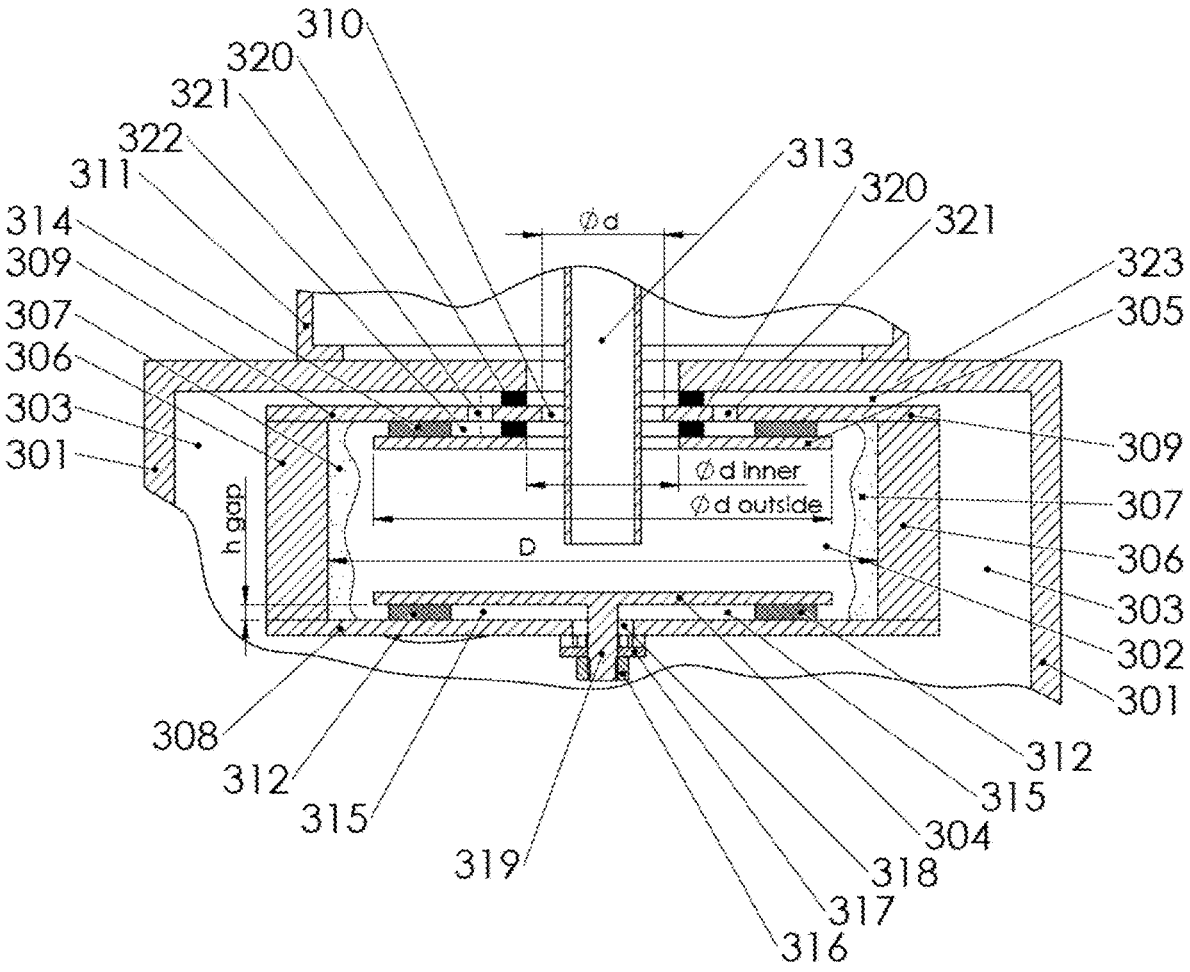
FIG. 3 is a frontal cross-sectional view of a vortex mill according to an embodiment of the present invention.

With reference to FIG. 3 the first embodiment of the present invention will now be disclosed.

As seen in FIG. 3 the vortex mill of the present invention, similarly to the knows in the art mill has an outer casing 301 with arranged therein a vortex milling chamber 302, such that there is provided a free volume 303 therebetween.

Furthermore, one should appreciate that in this embodiment are also employed tangentially directed nozzles for achieving the tornado-like condition within the milling chamber.

However, in contrast to the known in the art mills the vortex mill of the present invention is provided with at least one flat element, which is configured as dedicated lower additional disc 304 and an upper additional disc 305. The word additional is used here in the sense that they are in addition to the lower and upper flat disc walls of the milling chamber.

The role and construction of the additional disc elements 304 and 305 will be explained in details further.

The vortex milling chamber is delimited by a cylindrical side (periphery) wall 306 on which a layer 307 of comminuting powder accumulates. The milling chamber has an inside diameter D.

The milling chamber is further delimited by two opposite flat walls configured as a lower disc 308 and an upper disc 309. A central circular opening 310 is made in the upper disc 309. This opening has a diameter d and the opening serves for fluid communication between interior of the milling chamber and a discharge collector 311 arranged on the outer casing 301 of the mill.

Figure 3A:
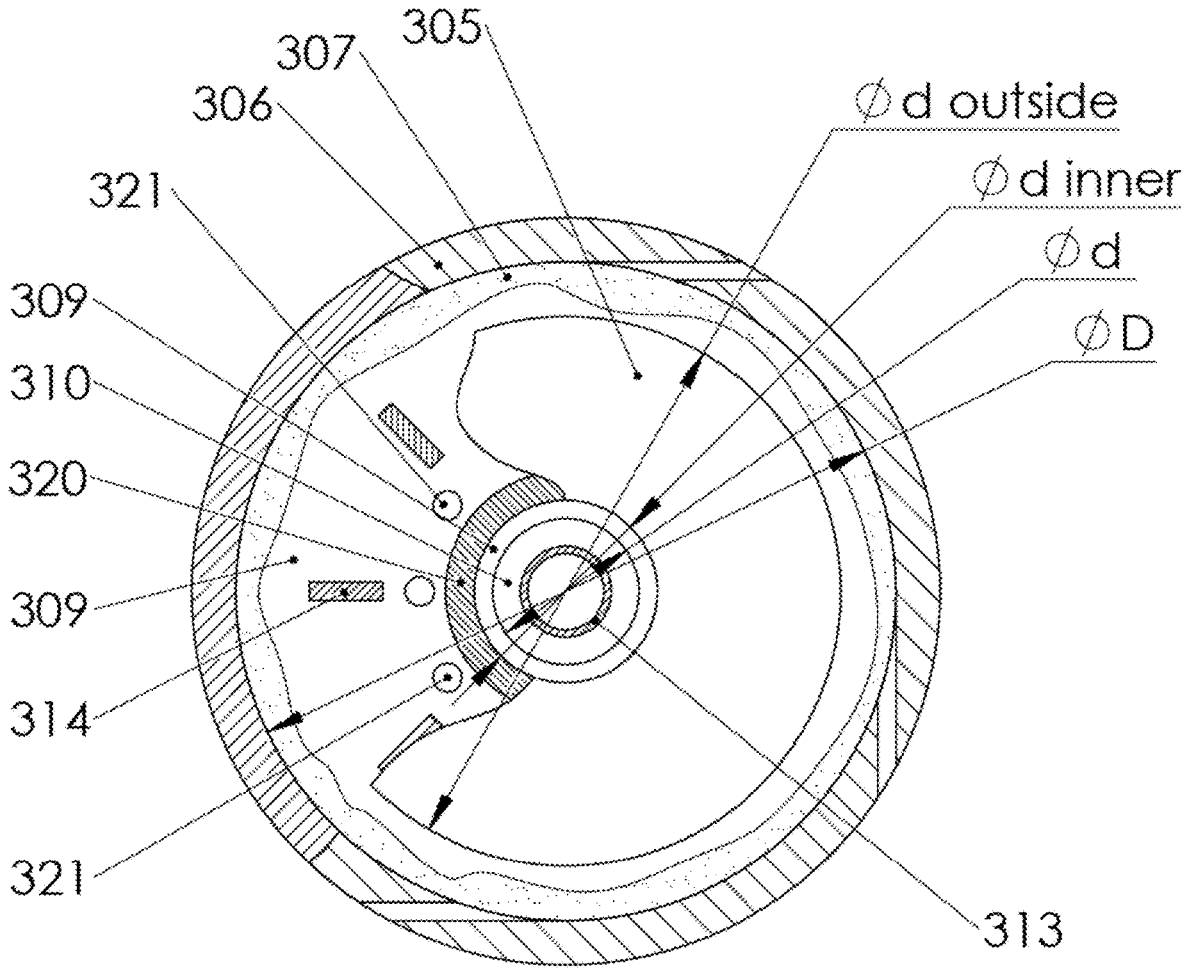

Situated between the lower additional disc 304 and the lower disc 308 of the milling chamber replaceable spacers 312 are provided. With reference to FIG. 3*a* it is seen that the spacers are configured and dimensioned preferably as discrete bodies situated radially on the lower disc 308. The additional lower disc 304 is situated concentrically with and parallel to the lower disc 308 such that through going fluid permeable circular gap 315 is provided, which is delimited by the lower disc 308, by the additional lower disc 304 and adjacent spacers 312.

The function of the spacers 312 is providing a desired gap distance designated as $h_{gap}$ between the lower disc 308 and the lower additional disc 304.

Passing through the casing, through the upper additional disc 305 and through the upper disc 309 a feeding tube 313 is provided. Similarly to the prior art vortex mill this tube is co-axial with the milling chamber and with the central opening 310 made in the upper disc 309 and it is in fluid communication with the milling chamber for feeding the raw material into the milling chamber.

The additional upper disc 305 is situated concentrically with and parallel to the upper disc 309 of the milling chamber. Situated between the upper disc 309 and the upper additional disc 305 a plurality of replaceable spacers 314 is provided. The spacers are configured and dimensioned preferably as discrete bodies, directed radially with respect to the upper disc 309 such that through going, fluid permeable circular gap is provided.

This arrangement has been already mentioned and is shown in FIG. 3*a*.

The function of the spacers is similar to the above explained arrangement in connection with the lower disc and additional lower disc, namely ensuring a desired distance also designated as $h_{gap}$ between the upper disc 309 and the upper additional disc 305.

In practice the spacers are made of a metal and they are configured preferably as rods having rectangular cross-section. The dimensions of the spacers can be for example as follows: 1.5 mm thickness×2 mm width×10 mm length.

As mentioned above the spacers are placed between the elements 304 and 308 such that they are directed radially and by virtue of this provision there is provided the gap 322 delimited by the adjacent spacers. The gap 322 should be configured and dimensioned such that free passage of compressed fluid supplied to the working would be possible. This can be achieved by selecting spacers having suitable thickness.

The lower additional disc 304 has an outside diameter $d_{outside}$. The upper additional disc 305 has an outside diameter $d_{outside}$ and an inner diameter $d_{inner}$.

As seen in the FIG. 3 the lower additional disc 304 is provided with a threaded rod portion 319, which passes through the lower disc 308. By virtue of this provision it is possible to secure the desired position of the lower additional disc 304 with respect to the lower disc 308. In practice for achieved this result a screwing nut 316 and a gas permeable washer 317 is used.

It can be readily appreciated that this arrangement allows also a simple and convenient replacing of spacers by spacers with desired thickness. By virtue of this provision it is possible to vary the distance $h_{gap}$ between the elements 309, 305 as well as between the elements 308, 304.

A gas permeable passage 318 is made in the lower disc 308. The gas permeable passage is formed in washer 317 to allow admittance of the compressed fluid from the volume 303 to the circular gap 315, and further towards the side wall 306 of the milling chamber.

Two sealing rings 320 are provided arranged beneath the upper wall of the casing and beneath the upper disc 309. One of the sealing rings being situated between the upper disc 309 and an adjacent upper wall of the casing, while the other sealing ring being situated between the upper disc 309 and the additional upper disc 305.

A gas permeable section 321 is made in the upper disc 309. This section is provided with a plurality of circular openings 321 as shown in FIG. 3*a*. By virtue of this provision fluid communication is possible between a space 323 delimited by the casing 301 and the upper disc 309 and between the circular gap 322.

It is not shown specifically but should be appreciated that the gas permeable section 321 made in the upper disc 309 as well as the passage 318 are connected with a source of compressed fluid. By virtue of this provision it is possible to arrange at least one additional flow of the compressed fluid within the milling chamber directed towards the side wall of the milling chamber. The term additional flow here means the flow arranged in addition to the flow of compressed working fluid supplied through tangential nozzles made in the side wall 306 of the milling chamber.

The additional flow organized through the space 323 between the casing and upper disc 309 passes through openings made in the gas permeable section 321 and through circular gap 322 between the upper disc 309 and additional upper disc 305 towards the side wall 306 of the milling chamber.

Direction of the additional flow should be opposite to direction of radial component of the velocity of the flow of compressed working fluid supplied through the tangential nozzles.

One should appreciate, however, that instead of a dedicated source of compressed fluid one can use the compressed fluid supplied therein through the fluid inlets 204 to the volume 303 delimited by casing 301 in the vortex mill.

In practice for obtaining the required additional flow the above mentioned dimensional parameters D, $d_{outside}$, $d_{inner}$, $h_{gap}$ can be varied.

It has been empirically revealed that if the additional flow of the compressed fluid takes place within the annular gaps 315 and/or 322 and if it is directed from the center of the milling chamber radially towards the side wall of the milling chamber, a very positive result of vortex milling can be achieved. Specifically this result can be expressed in terms of significant reducing the achievable parameters d(90) and d(100).

Furthermore it has been revealed that for reducing of the above parameters no additional time or energy is required.

Now with reference to non-limited table 1 and FIG. 4 results of milling in a vortex mill designed as explained above and employing additional flow of compressed fluid will be discussed.

Raw powder of tree calcium citrate with initial parameter d(50)=5.1 μm was milled.

Pressure of fluid at entrance to the mill was 3 bars and feeding rate of the raw material was 5.7 kg/hr. Additional flow of compressed fluid was arranged at the upper disc 309 of the milling chamber.

In the non-limiting table 1 below are shown the achieved results of the vortex milling.

| Vortex milling | d(10)μm | d(50) μm | d(90) μm | d(100) μm |
|---|---|---|---|---|
| 1 (without additional flow) | 0.72 | 2.0 | 4.6 | 9.8 |
| 2 (with additional flow) | 0.67 | 1.9 | 4.2 | 6.7 |

The above results unambiguously show that vortex milling with additional flow of compressed fluid improves all particle size distribution parameters of the milled powder and especially the parameters d(90) and d(100).

Figure 4:
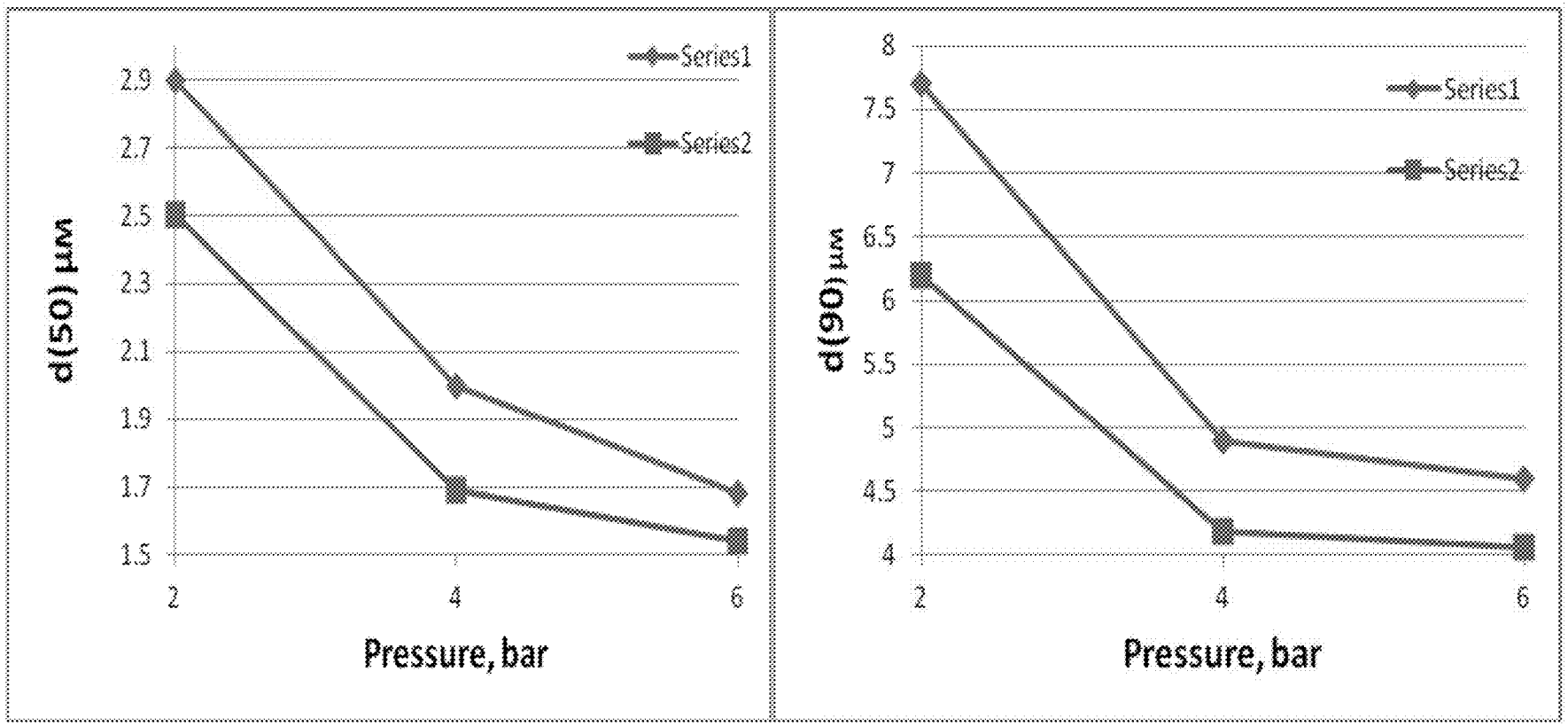
FIG. 4 illustrates the improvement of powders characteristics d(50) and (90) obtained from graphical representation of particle size distribution of powders comminuted in the vortex mill shown in FIG. 3.

In FIG. 4 is shown how the d(50) parameter and the d(90) parameter depends on pressure of the compressed working fluid supplied to the milling chamber with (series 2, regular tetragones) and without (series 1, diamonds) additional flow.

The feeding rate of the raw material was kept constant and equal to 3.6 kg/hour. Additional flow of compressed fluid was arranged at the lower disc 308 of the milling chamber.

For both parameters one can see that their unequivocal improvement took place with the additional flow of fluid.

As mentioned above the constructional parameters of the mill, i.e. D, $d_{inner}$, $h_{gap}$ can be varied and this was carried out in order to influence on the achievable parameters of particle size distribution.

In particular it has been empirically discovered that with the vortex mill designed in accordance with the embodiment shown in FIG. 3, the improvement of the parameters takes place if the following condition is satisfied: $d_{outside}<0.9$ D.

Furthermore, when the $h_{gap}$ parameter is varied between 0.5 mm up to 2.5 mm, it has been found that, when the parameter $h_{gap}$ is more than 1.5 mm the efficiency of the additional flow reduces. It has been also discovered, when the pressure of working fluid is increased up to 6 bar, that there exists a pressure threshold, above of which organization of the additional flow becomes inefficient as well.

Combining of these facts led to the conclusion that the efficiency of the additional flow reduces when flow rate of the additional flow is more than 16% of the flow rate of the working fluid supplied through the tangential nozzles.

In particular, when two additional flows are arranged (at the lower disc and at the upper disc) and when flow rate through the tangential nozzles is 200 $nm^3$/hour, than flow rate of each additional flow should not exceed 16 $nm^3$/hour.

If only one additional flow is arranged (either at the lower disc or at the upper ring), than the flow rate of the additional flow should not exceed 32 $nm^3$/hour.

Thus one can see that by virtue of arranging of at least one additional flow as explained above customizing of particle size distribution is possible.

Figure 5:
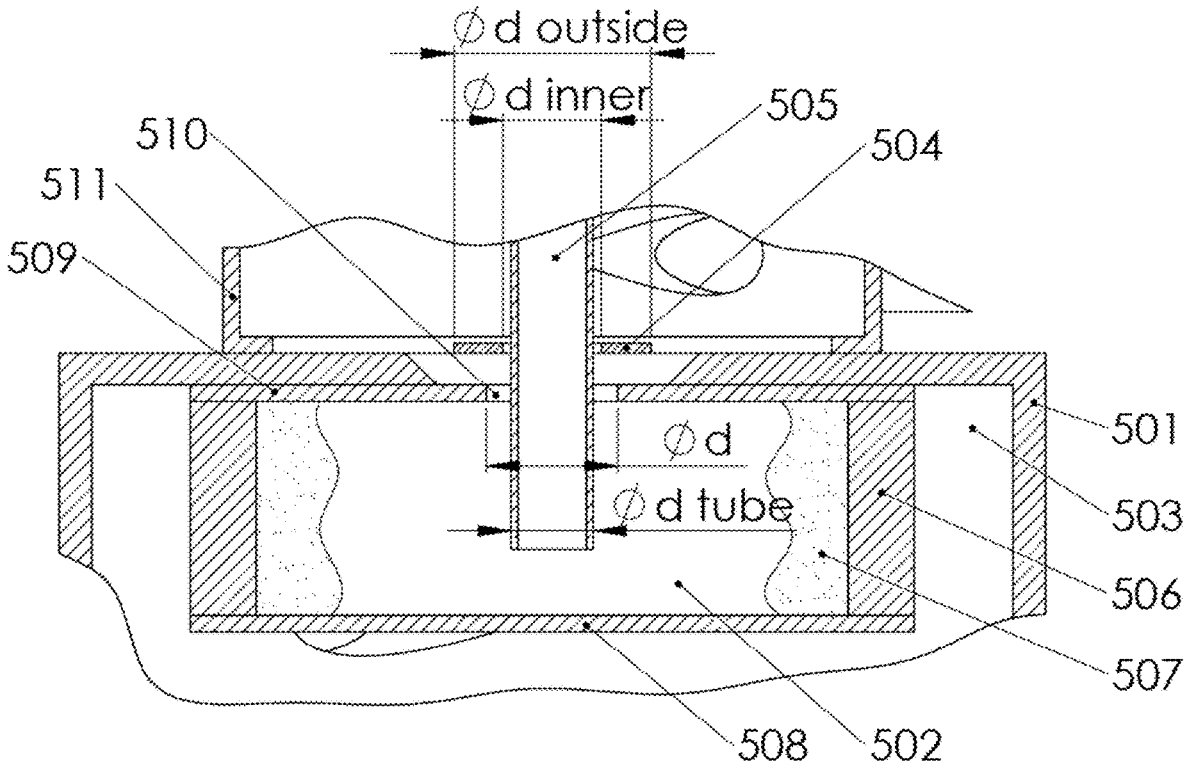
FIG. 5 is a frontal cross-sectional view of a vortex mill according to another embodiment of the present invention.

Referring now to FIG. 5 an additional embodiment of the present invention will be explained.

In this embodiment, similarly to the explained above prior art vortex mills, are employed some similar components, which allow establishing of tornado-like condition within the milling chamber of the vortex mill.

In particular the similar components of the mill include an outer cylindrical casing 501, in which is disposed a vortex milling chamber 502 such that a free volume 503 is provided therebetween. The milling chamber is delimited by a vortex milling chamber side wall 506, by a lower disc 508 and by an opposite upper disc 509. A central opening 510 is made in the upper wall. The central opening has a diameter d.

Accumulating on the side wall 506 a layer 507 of the comminuting material is shown.

Arranged on the upper disc 509 a discharge collector 511 is provided, which is in fluid communication with the milling chamber 502 by virtue of the central opening 510 as well as respective co-axial openings made in the casing wall and in a wall of the discharge collector.

Passing co-axially with the milling chamber and through the discharge collector a feeding tube 505 for feeding the raw material is provided. The feeding tube is in fluid communication with the milling chamber such that during operation of the mill raw material could be continuously fed into the nulling chamber. The feeding tube has an outside diameter designated as $d_{tube}$.

It is not shown in FIG. 5 but should be appreciated that a source of compressed working fluid is also provided. This source is in fluid communication through an inlet port with the volume 503 and with interior of the milling chamber via a plurality of nozzles, directed tangentially with respect to the side wall 506 of the milling chamber 502.

In contrast to the prior art vortex mills construction of the vortex mill in accordance with this embodiment includes a comminuting control component enabling obtaining comminuted material with customized parameters of particle size distribution. This new component is an oscillating ring or washer 504, which is arranged on the feeding tube 505 with possibility for reciprocating linear movement along the feeding tube. This reciprocating linear movement of the ring is possible since its opening has a diameter designated $d_{inner}$, which exceeds diameter $d_{tube}$ of the feeding tube. Furthermore, an outside diameter of the ring designated as $d_{outside}$ is slightly (in practice by 2÷3 mm) more than diameter d of the central opening 510, i.e. $d_{outside}>d+(d_{inner}-d_{tube})$.

In the further disclosure the terms reciprocating and oscillating are synonyms and their meaning is to move a mechanical element backwards and forwards between two points. The terms throbbing and pulsating are synonyms also, but their meaning is a periodical changing of a fluid density, which can be immovable or can participate in fluid flow.

In practice the washer is made of a metallic material, e.g. stainless steel, or from a non-metallic material, e.g. Teflon.

The vortex mill in accordance with this embodiment operates as follows.

Compressed working fluid is fed into the milling chamber through tangential nozzles.

Tornado-like condition is established within the milling chamber 502 and the working fluid with the comminuted powder distributed therein moves towards the discharging collector 511 via central opening 510. While this fluid medium passes through the central opening 510 it urges the ring 504 to oscillate up and down along the feeding tube. White oscillating the ring operates like a valve, which periodically opens and closes the central opening 510. By virtue of this provision a pulsating pressure establishes in the milling chamber, which results in forced vibrations induced in particles of the comminuting powder. The forced vibrations are defined by a frequency from ~5 Hertz (at low pressure) up to 460 Hertz (6.5 bar, oscillating washer 504 made of Teflon).

It has been empirically revealed that eventually the establishing of the phenomenon of pulsating pressure improves efficiency of milling.

In particular it has been found, that parameters of particle size distribution d(50), d(90) and d(99) can be customized.

Figure 6:
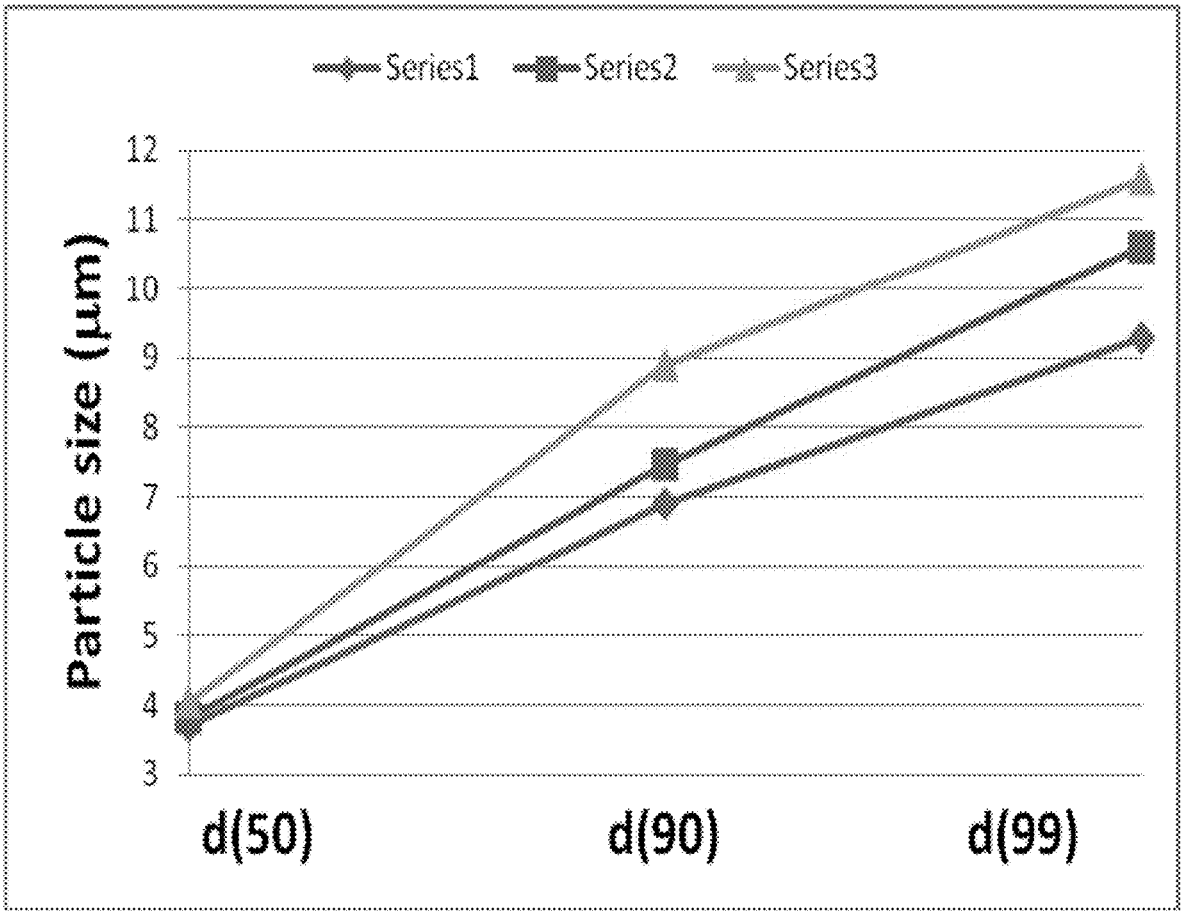
FIG. 6 illustrates the improvement of powders characteristics d(50), d(90) and d(99) obtained from graphical representation of particle size distribution of a powder comminuted in the vortex mill shown in FIG. 5.

With reference to the further non-limiting example and FIG. 6 it will be disclosed now how the above mentioned parameters were customized with the aim of vortex mill designed in accordance with the embodiment shown in FIG. 5.

Three groups of experiments were conducted, in which dolomite raw material was milled in the vortex mill designed in accordance with this embodiment. In one group of experiments was used the mill without the oscillating washer and in two other groups was used the same mill but provided either with stainless steel washer or with Teflon washer. The stainless steel washer weighed 23 gram and the Teflon washer weighed 6 gram.

The pressure of the working fluid at the mill entrance was kept constant and equal to 2 bars, 4 bars and 6 bars. The feeding rate of the dolomite raw material was kept equal to 4 kg/hour in all groups of experiments.

In FIG. 6 is presented graphically the particle size in μm for the parameter d(50), d(90) and d(99) as obtained after vortex milling with the Teflon washer (series 1, diamonds), without washer (series 2, squares) and with the stainless steel washer (series 3, triangles).

It can be seen that the lowest values of the above parameters were obtained after milling with the Teflon washer.

Furthermore it has been found that there exists a frequency threshold above of which the most positive results of the milling with oscillating Teflon washer can be achieved. This threshold is 180 Hertz at the feeding pressure of 4 bars.

Thus the vortex mill designed in accordance with this embodiment can also be used for obtaining comminuted powder with desired particle size distribution parameters.

Figure 7:
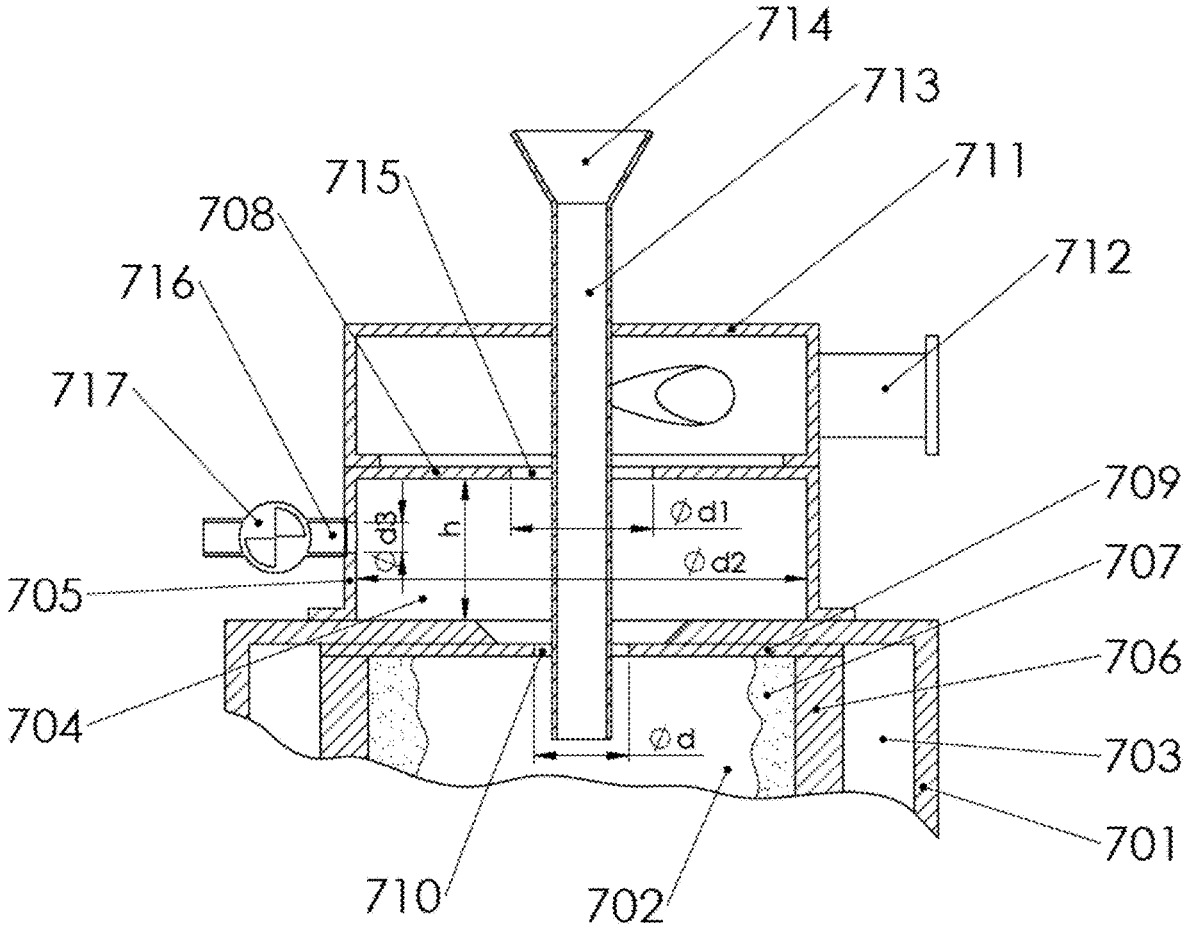
FIG. 7 is a frontal cross-sectional view of a vortex mill according to still further embodiment of the present invention.

With reference to FIG. 7 it will be disclosed now still further embodiment of the vortex mill of the present invention.

This embodiment is especially suitable for solving a well-known problem associated with presence of coarse, oversized particles in the comminuted powder. Although their amount is might be relative small, nevertheless there exist applications, in which then presence is absolutely inacceptable and therefore additional time and energy should be invested in order to exclude them from the final product.

As seen in FIG. 7 the vortex mill comprises its main features, which are common with the prior art vortex mills. The common features include an outer cylindrical casing 701 with situated therein a nulling chamber 702, a free volume 703 between the casing and the milling chamber, a side wall 706 of the milling chamber, a layer 707 of comminuting material accumulating during operation of the mill, an upper disc wall 709 of the milling chamber, an opposite lower disc wall of the milling chamber (not shown), a central opening 710 made in the upper disc 709, a discharge collector 711 having an outlet port 712 and a feeding tube 713 provided with a funnel 714. It is not shown in FIG. 7 but should be appreciated that a source of compressed working fluid is provided for admitting the compressed working fluid in the volume 703. Furthermore one should appreciate that in the side wall 706 a plurality of nozzles is arranged for directing the working fluid admitting in the milling chamber tangentially and establishing the tornado-like condition.

However, in contrast to the prior art vortex mill in this embodiment, the mill is retrofitted with a new element which is an auxiliary chamber 704, situated preferably on an upper wall of the casing 701, that serves as a lower disc wall of said auxiliary chamber. The auxiliary chamber 704 will be referred-to further as separating chamber.

It is seen in FIG. 7 that the separating chamber 704 is preferably configured as a cylinder delimited by a lateral wall 705 and by opposite flat disc walls. It is also seen that a central opening 715 is made in the upper disc wall 708 of the separating chamber 704, which is adjacent with the discharge collector 711. By virtue of this provision fluid communication is possible between the milling chamber 702, the separating chamber 704 and the discharge collector 711. The separating chamber 704 is preferably disposed co-axially with the milling chamber and the central opening 710 of the milling chamber is co-axial with the central opening 715 of the separating chamber 704.

Situated on the lateral periphery wall 705 of the separating chamber 704 a side discharge pipe 716 is provided. The cross-section of the pipe 716 can be varied by a control valve 717. As shown in FIG. 7 the separating chamber is defined by an inside diameter $d_2$, by a height h, by a diameter $d_1$ of the central opening 715, and by a diameter $d_3$ of the pipe 716. The central opening 710 of the milling chamber has a diameter d.

During operation compressed working fluid is admitted to the milling chamber, while raw particulate material to be comminuted is fed through the feeding tube 713 to the milling chamber.

It has been empirically revealed that by proper selection of the above mentioned parameters d, $d_1$, $d_2$ $d_3$ and h it is possible to very efficiently control the vortex milling process such that the fine fraction of the comminuted powder could be collected via the outlet port 712, while the total coarse fraction could be collected via the discharge pipe 716. In particular the following conditions for selecting the proper parameters should be met: $h>1.5\ d$, and $d_2>(d_1+2\ d)$.

Furthermore it has been revealed that efficient comminution control is possible when the amount of comminuted material (in terms of mass flow rate) discharged through the discharge pipe 716 is not more than 3% of the total mass of the raw material fed in the milling chamber (in terms of feeding rate). This condition is satisfied when the cross-sectional surface area of the pipe 716 is nest more than 4% of the surface area of the central opening 710. In practice the valve 717 can be used for adjusting this parameter of the discharge pipe 716.

Now with reference to FIG. 8 results of vortex milling in the vortex mill provided with the separating chamber 704 will be discussed. The results were obtained by vortex milling of dolomite.

Figure 8:
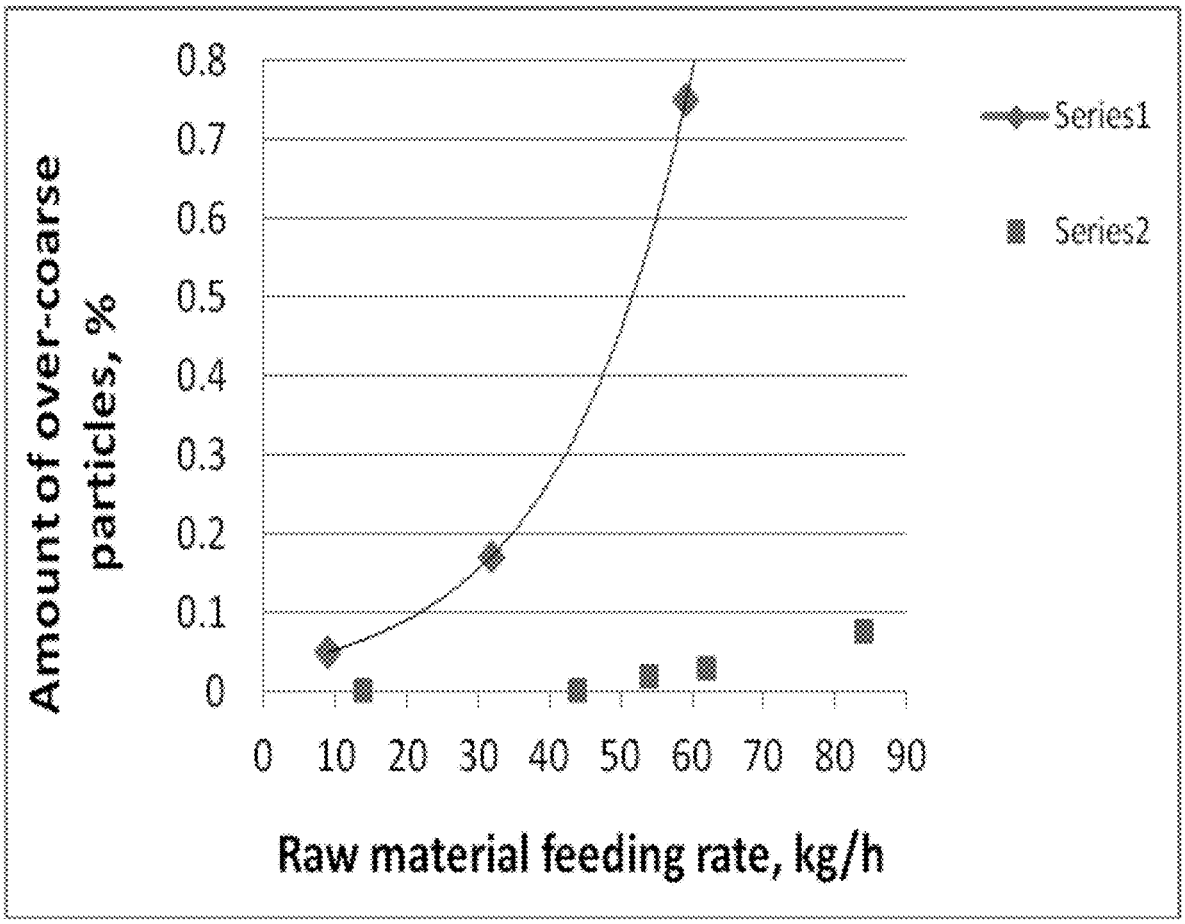
FIG. 8 is graphic representation of weight percent of coarse particles in the powder comminuted in the vortex mill shown in FIG. 7 as function of feeding rate of raw material.

In FIG. 8 is presented amount (in weight percent) of oversized (more than 100 μm) particles present in the comminuted powder as function of raw material feeding rate.

It can be clearly seen that the amount of coarse particles in the final powder is significantly less when vortex milling is carried out with the separating chamber (series 2, squares), than without the separating chamber (series 1, diamonds).

Thus by retrofitting the prior art vortex mill with the separating chamber, which constructional parameters are selected in accordance with the above-mentioned criteria it is possible to control the comminution process such that desirable customizing of particle size distribution could be achieved.

Figure 9:
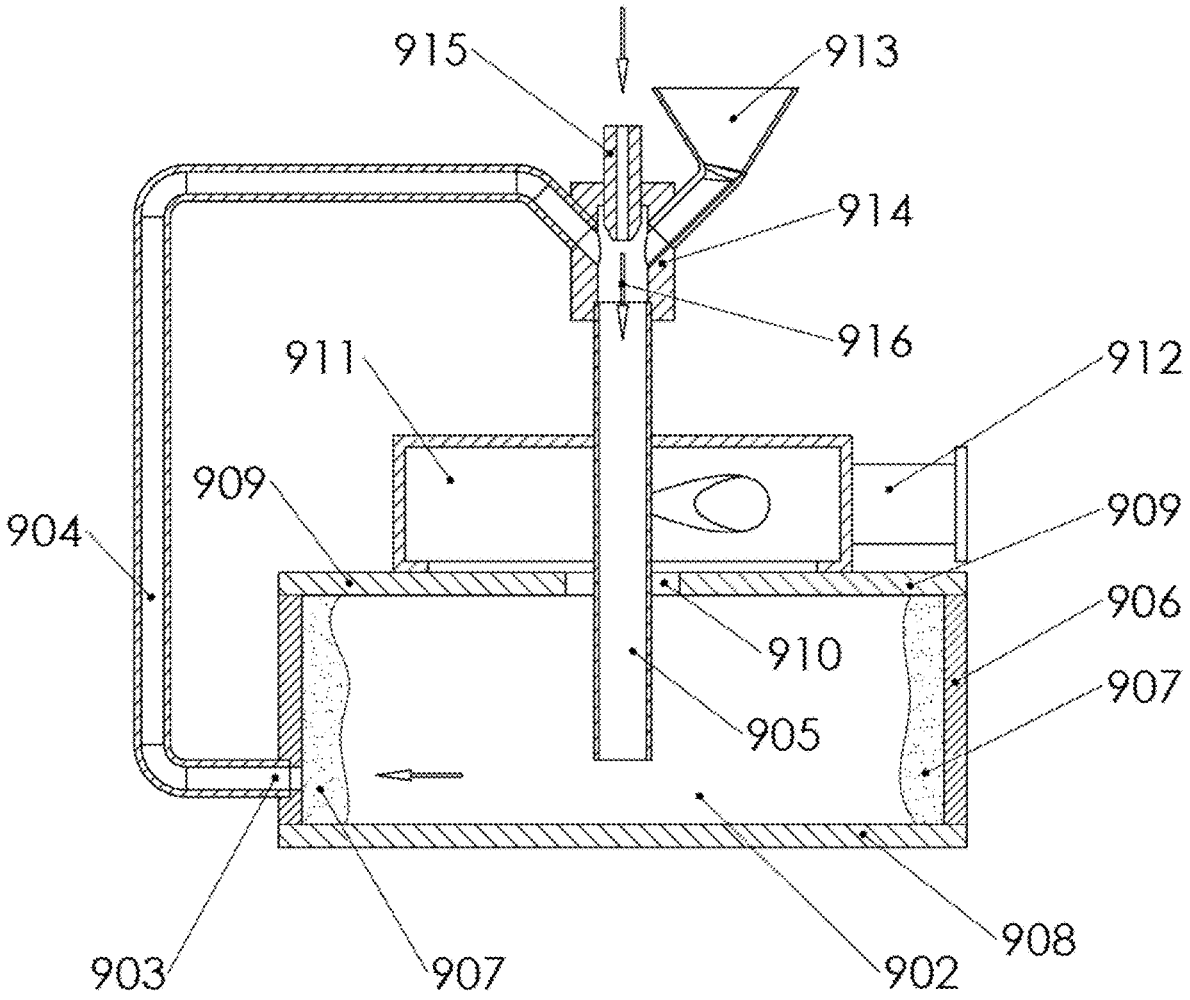
FIG. 9, FIG. 9*a* and FIG. 10 are schematic cross-sectional views of a vortex mill according to still further embodiments of the present invention.

Referring to FIG. 9 a still further embodiment of the present invention will now be explained. This embodiment similarly to the previous one is intended for obtaining of comminuted powders, in which the amount of coarse fraction has to be kept at a certain minimum dictated by specific service requirements, the final powder should comply with.

It is seen in FIG. 9 that the vortex mill of this embodiment similarly to the previous embodiments is provided with a cylindrical milling chamber 902 delimited by a cylindrical side wall 906, by a lower disc wall 908 and by an opposite upper disc wall 909.

Furthermore a layer 907 of the comminuting material accumulating on the cylindrical wall 906 is depicted. A central opening 910 is made in the upper disc wall 909 and a concentric opening is made in the lower wall of the discharge collector 911. By virtue of this provision flow communication is possible between the milling chamber 902 and a discharge collector 911 situated on the upper disc wall 909 of the milling chamber 902. The discharge collector is fitted with an outlet port 912 for discharge of the comminuted powder from the discharge collector 911.

A feeding tube 905 fitted with a funnel 913 is provided. The feeding tube has open upper end and open lower end. The feeding tube 905 is co-axial with the central opening 910 of the milling chamber 902 and it passes through the central opening 910 such that continuous or periodic feeding of raw particulate solids into milling chamber is possible. It not shown but should be appreciated that the side wall of the milling chamber is fitted with at least one nozzle for supplying tangentially directed compressed working fluid into the milling chamber and creating therein the tornado-like condition.

Up to now there were mentioned only the components which are common with the prior art vortex mill and with the mills of the previous embodiments.

The milling chamber of the embodiments shown in FIG. 9 is provided with a side discharge port 903 made in the side cylindrical wall 906. This port is intended for discharge of the comminuted powder. This feature when taken alone is also known from the prior art vortex mills.

However in contrast to the prior art, in the present embodiment this port is connected through a pneumatic conveying line 904 with an ejector 914. The upper end of the feeding tube is also connected with the ejector 914.

The ejector 914 is intended for maintaining certain level of under-pressure at the entrance of the feeding tube, thus enabling suction into the milling chamber both the raw material from the funnel and the comminuted powder discharged from the side discharge port 903.

It should be borne in mind that employing of ejectors is known in the prior art. However, the known ejectors are usually designed as so-called Ventury devices which typically employ a supersonic de Laval nozzle. In contrast to this construction the ejector used in this embodiment is not designed as Ventury device and it is not fitted with the supersonic de Laval nozzle. Construction of the ejector includes a nozzle 915 through which compressed air is supplied to the ejector as shown by an arrow 916 to obtain therein the desired level of under-pressure, which is sufficient for suction into the milling chamber both the raw material from an outside feeder (not shown) and the comminuted powder discharged from the side port 903.

By virtue of this specific ejector it is possible to maintain significantly lower flow rate and pressure in the nozzle 915, which results in stable pneumatic conveying of the comminuted powder through the pneumatic conveying line 904. In practice one can use the nozzle having diameter of 3 mm and to maintain pressure of up to 4 bar (at flow rate up to 25 $nm^3$/hour).

In accordance with the invention it is also important where are connected the pneumatic conveying line 904 and the feeding funnel 913 with the ejector 914. In particular it is essential that the points of connection of the conveying line 904 and of the feeding funnel 913 are located in the zone of the under-pressure produced by the ejector. In practice this location is in vicinity of the jet exiting from the nozzle 915.

By virtue of the vortex mill designed in accordance with the embodiment shown in FIG. 9 it was possible successfully fulfill a complicated customizing task to comminute a pharmaceutical particulate material. The final powder was obtained using the mill of the present invention with the preset parameter d(99) of the particle size distribution, while the preset parameter d(10) remained virtually unchanged. This was possible inter alia by controlling pressure of the compressed working fluid, by controlling the under-pressure created by the ejector and by controlling the feeding rate of the raw material fed through the feeding tube 905.

Figure 9A:
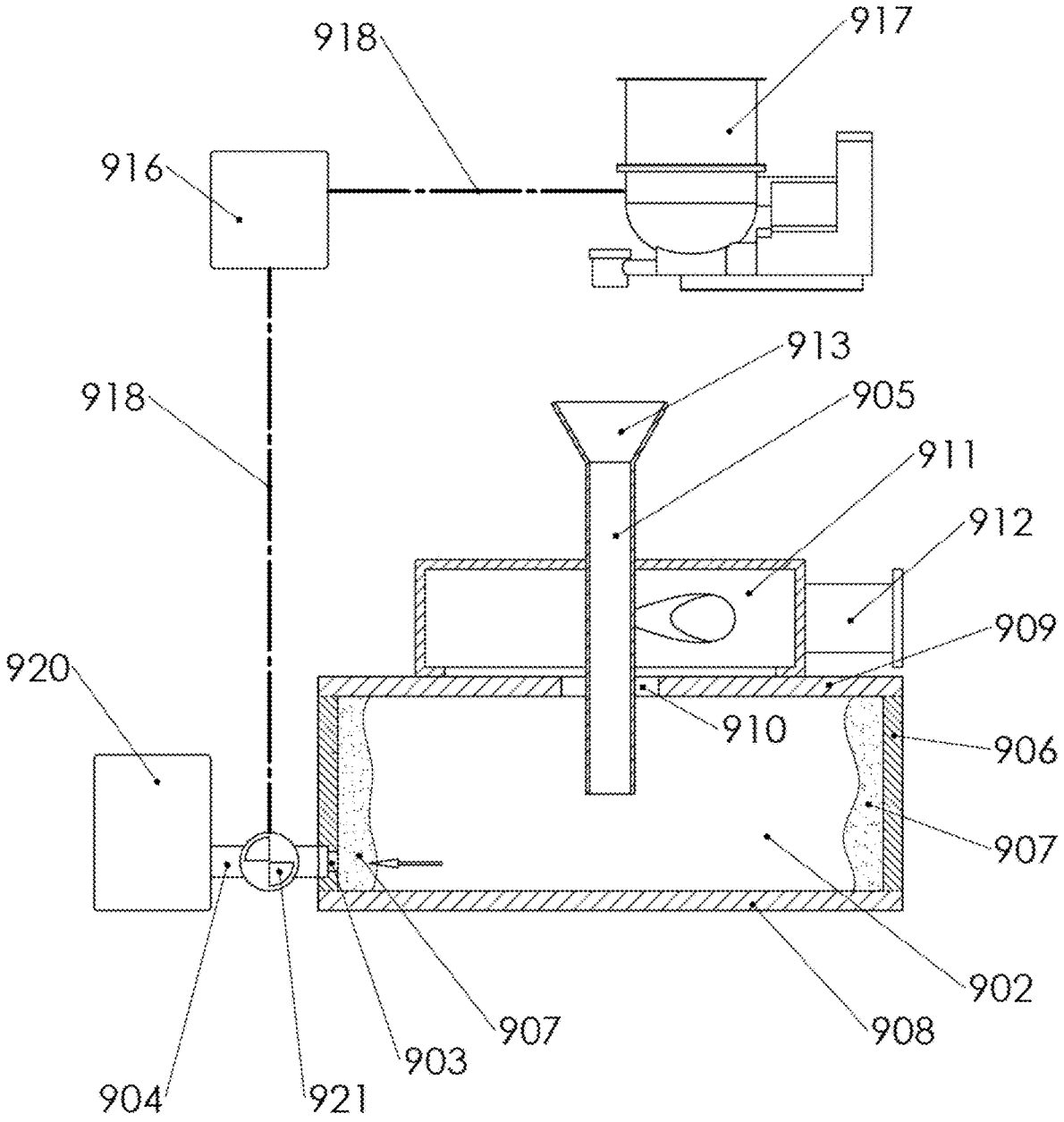

Still further embodiment of the present invention is seen in FIG. 9*a*, which is in fact more sophisticated variant of the embodiment shown in FIG. 9.

With this embodiment it was possible to comminute a particulate metallic oxide up to a preset value of the parameter d(50) which was as low as 2.5 μm. The difficulty in comminution up to this especially low parameter was associated with the fact that the raw material contained a small amount (about 1.5 weight percent) of an addition that consisted of oxide of the same metal, but with different valence. The addition had different color and different ability to comminute. The second material was practically not milled and has been accumulated inside the vortex milling camber. The mass of solid material in the vortex layer 907 has been increasing, while rotation velocity decreasing.

By virtue of the more sophisticated embodiment, shown in FIG. 9*a* and which will be immediately disclosed it was possible to solve the problem and obtain final product with the required preset parameter d(50).

As seen in FIG. 9*a* the most of the elements of this embodiment are common with those of the previous embodiment. Such common elements are milling chamber 902, side discharge port 903, pneumatic conveying line 904, feeding tube 905, side wall of the vortex milling chamber 906, vortex layer 907, lower disc of the milling chamber 908, upper disc of the milling chamber 909, discharge central opening 910, discharge collector 911, outlet port 912 and funnel 913. For the sake of brevity the common elements are designated by the same reference numerals and are not described in details.

In contrast to the previous embodiment the conveying line is connected not with the ejector but with a receptacle 920 for collecting the discharging material. A controllable valve 921 is provided in the conveying line, which periodically closes and opens the line upon a signal received from an operating control system 916, which is in electrical connection with the valve 921.

Situated above the funnel 913 a feeder 917 of raw material is provided. The feeder 917 is electrically connected with the operating control system 916 via respective signal line 918.

In accordance with this embodiment the mill operates as follows.

The operating control system 916 is set such that it periodically sends a signal to the valve 921 to open or close the side discharge port 903. Thus the mill operating cycle consists of two phases:

a) the discharge port 903 is closed for about 10 minutes b) the discharge port 903 is opened for about 15 seconds.

During the phase b) the metal oxide addition that has been accumulated in the chamber is evacuated from the vortex milling chamber and thus the total mass of the fed raw material could be continuously comminuted. In practice it is convenient to use a commercially available component, for example the solenoid valve manufactured by the company ACL Italy. With this component it is possible to set the time during which the valve 921 is open or closed and to set period of time between two consecutive cycles of closing and opening.

When the side discharge port 903 is open, the good material is discharged into receptacle 920 along with the undesirable addition. In an attempt to reduce the amount of good material discharging from the side discharge port 903, an additional relay can be used for controlling operation of the feeder 917. This relay is not shown specifically in FIG. 9*a*, however one can appreciate that it is retrofitted in the operating control system 916. The relay can be set such that the operating control system generates a signal to switch on or off the feeder 917. In practice the feeder should be switched off for 15 seconds before opening the side discharge port 903. During this period of time the side discharge port 903 is closed, the new raw material is not feed into the mill, and the remaining amount of the good material is sufficient for comminuting and evacuation thereof from the milling chamber. At the moment when the side discharge port 903 opens, practically only the addition of metal oxide remains in the vortex layer 907 and only this material discharges into receptacle 920. The feeder is switched on simultaneously with closing the valve 921.

In the working cycle of comminuting as described above the important and necessary characteristics of the cycle comprise three periods of time as follows:

a) $t_1$ which is period of time after expiring of which the side discharge port 903 has to be opened
b) $t_2$ which is period of time between consecutive opening and closing the valve
c) $t_3$ which is period of time before opening the valve when the feeder is switched off.

The above-mentioned periods of time depend on various parameters and in particular on pressure at the entrance into the milling chamber, rate of feeding the raw material, properties of the raw material, properties of the material of addition, amount of the addition.

In the above-mentioned example those parameters were: $t_1$=10 minutes, $t_2$=15 seconds and $t_3$=15 seconds.

Figure 10:
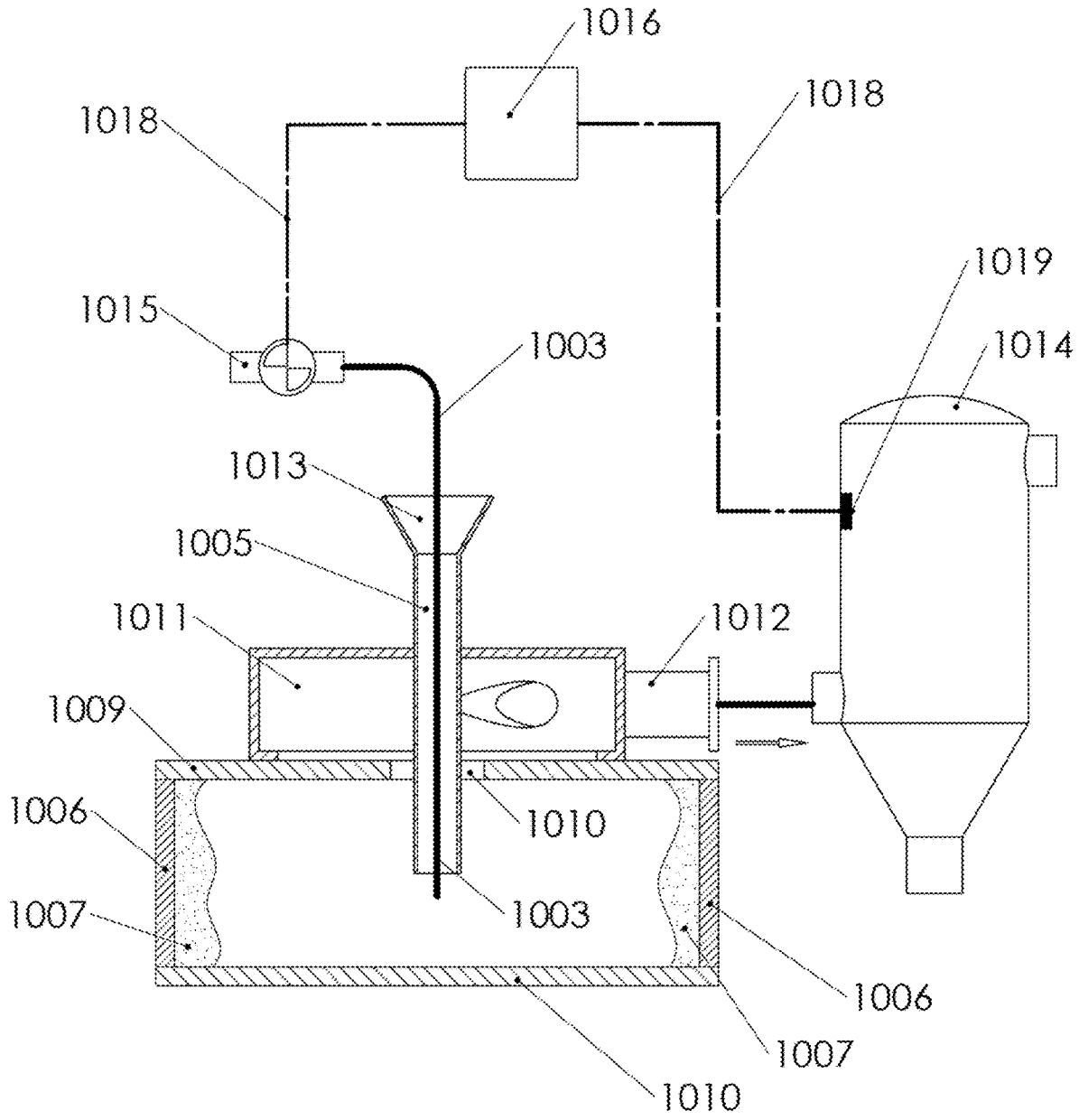

Referring now to FIG. 10 still further embodiment of the vortex mill in accordance with the invention will be discussed. By virtue of this embodiment it is possible to solve one of the frequently observed problems taking place during vortex milling, namely adhesion of the comminuted material to the inwardly facing surface of the milling chamber. This phenomenon prevents obtaining comminuted material with preset parameters of particle size distribution.

Furthermore, it requires terminating the comminution process, dismantling the milling chamber and cleaning its interior.

The common reason for adhesion of various materials during their comminution is formation on the comminuted particles of new active surfaces having free electrical and molecular bonds.

In order to prevent adhesion it is known to cover the interior of the milling chamber by a special material, e.g. polyurethane, Teflon, etc. Unfortunately such coating materials are not always available and besides the phenomenon of adhesion takes place on the coated surfaces coated by these materials as well.

It has been empirically revealed that addition of water is a good solution for preventing adhesion of the comminuted materials during vortex milling.

It should be appreciated however that this measure would be suitable for comminuting of materials, which are insoluble in wafer and merely those materials, which powders do not absorb water or its vapor or when there is no influence of vapor absorption on the properties of those materials.

Furthermore one should appreciate that this measure is suitable merely for those materials which are comminuted in atmosphere of dry air, nitrogen, or some other gaseous medium except of water steam.

According to this embodiment, the level of drying of the gaseous medium should be rather high. So for example if air is used it should be dried up to the Dew point 3° C. or up to −40° C.

If water is used it should be electrically conductive and therefore distilled water is not suitable.

The amount of water added to the milling chamber should be such that, when this amount fully evaporates, the humidity of a gas outside the milling chamber will be less than 100%.

The amount of water can be controlled by a sensor, which measures humidity in the gaseous medium. This sensor should be located at the exit from the milling chamber. For example it can be located inside a filter of a collection receptacle.

For preventing adhesion of the comminuted material, water should form a thin film on the side wall of the vortex chamber. This water film is continuously evaporated; therefore, water must be added to a milling chamber. The further important aspect is how water is supplied into the milling chamber.

It was found that water can be admitted into the milling chamber via a thin pipe extending along the feeding tube and having small inner diameter, for example 2 mm.

The embodiment of milling chamber adapted for addition of water during the comminution process is seen in FIG. 10. In this embodiment are employed similar elements as in the previous embodiments and for the sake of brevity they will be merely listed according to the corresponding reference numerals. The similar elements are: vortex milling chamber 1002, feeding tube 1005, vortex milling chamber side wall 1006, lower disc 1008 of the vortex chamber, upper disc 1009 of the vortex chamber, central opening 1010 made in the upper disc for discharge of the comminuted material from the sniffing chamber into discharge collector 1011, which is fitted with outlet port 1012, funnel 1013.

The new elements of this embodiment comprise a dedicated setup for the prevention of material sticking on inner surfaces of the milling chamber. This setup comprises a water supply unit, an operating control system and a humidity sensor. The setup further comprises a water supply pipe 1003, which extends along the feeding tube 1005 and during operation of the mill continuously supplies water to the milling chamber 1002. It should be appreciated that this pipe 1003 is in flow communication with a source of water, which is not seen in FIG. 10. A controllable valve 1015 is electrically connected via a control line 1018 with a control system 1016 and can change the water flow rate through the pipe 1003. It is also seen that a collection receptacle 1014 is provided, which is fitted with a filter (not seen). The collection receptacle 1014 is connected with the outlet port 1012 such that the comminuted powder can be evacuated from the discharge collector 1011 into collection receptacle 1014. A humidity sensor 1019 is provided, which is situated preferably on the inwardly facing surface of collection receptacle 1014 near the filter. The humidity sensor is electrically connected with the control system 1016 via control line 1018.

During operation the humidity sensor continuously sends to the control system the current value of humidity in the air around the comminuted powder. The control system can be programmed such that according to certain, preset value of humidity it automatically generates and sends to the valve 1015 a control signal to change the cross section of said water supply pipe and accordingly the amount of water supplied into the milling chamber is increased or decreased.

By virtue of the vortex mill designed in accordance with this embodiment it was possible to prevent adhesion of comminuted powder to the side wall of the milling chamber made from the stainless steel. Accordingly it was still possible to achieve the required customizing of characteristics of the particle size distribution.

Thus by virtue of the present invention it becomes possible to control the comminution process such that the comminuted material has particle size distribution with preset customizable characteristics.

It should be appreciated that the present invention is not limited to the above-described examples and that one ordinarily skilled in the art can make changes and modifications without deviation from the scope of the invention, as will be defined in the appended claims.

It should also be appreciated that the features disclosed in the foregoing description, and/or in the following claims, and/or in the accompanying drawings may, both separately and in any combination thereof, be material for realizing the present invention in diverse forms thereof.

When used in the following claims, the terms "comprise", "include", "have" and then conjugates mean "including but not limited to".

The invention claimed is:

1. A vortex mill for comminuting of a raw particulate material, said mill comprises:

a milling chamber, said milling chamber being delimited by a side cylindrical wall, by a lower flat disc and by an opposite upper flat disc, wherein a central opening is provided in the upper disc, said opening has a diameter d, and at least one nozzle is arranged in the side wall of the milling chamber, said vortex mill further comprises at least one inlet port for supplying a compressed working fluid into the milling chamber such that said a compressed working fluid could be supplied through the at least one nozzle tangentially into the milling chamber, the vortex mill further comprises a discharge collector, which is in fluid communication with the milling chamber via the central opening made in the upper disc, and a feeding tube is provided which is in fluid communication with the milling chamber so as to supply the raw particulate material into the milling chamber, said feeding tube has an outer diameter $d_{tube}$, wherein said diameter d of the central opening in the upper disc is dimensioned so as to allow passing a comminuted material carried by the working fluid through the central opening into the discharge collector, wherein said vortex mill further comprises at least one of additional lower disc and additional upper disc, which is detachably fastened within the milling chamber so as to be adjacent with and parallel to the corresponding lower or upper disc such that there is provided at least one circular gap therebetween, the vortex mill being such that an additional flow of said compressed working fluid passing via said at least one circular gap is arranged within the milling chamber, said additional flow is adjacent with at least one of said lower disc and upper disc of the milling chamber and is directed radially from a center of the milling chamber and towards the side wall thereof, in which said side wall of the milling chamber is characterized by a diameter D, wherein said at least one of additional lower disc and additional upper disc have an outer diameter $d_{out}$, wherein said additional upper disc of said at least one of additional lower disc and additional upper disc, is provided with a central opening having a diameter $d_{inner}$, relations between dimensions of the at least one of additional lower disc and additional upper disc and the respective corresponding lower or upper disc of the milling chamber is maintained: $d_{out}<0.9D$ and $d_{inner}>d$, further wherein said vortex mill comprising a plurality of spacers detachably fastened between said lower disc or said upper disc and corresponding said at least one of additional lower disc and additional upper disc, said spacers having a thickness, which is equal to a distance $h_{gap}$ between the lower or upper disc and corresponding at least one of additional lower disc and additional upper disc, wherein said additional flow of said compressed working fluid can be supplied from a volume outside the milling chamber to said at least one circular gap, wherein a flow rate of the additional flow does not exceed 16% of a flow rate of a flow of said compressed working fluid tangentially supplied through said at least one nozzle.

2. The vortex mill as defined in claim 1, in which the lower disc is provided with a permeable central passage and wherein said additional lower disc of said at least one of additional lower disc and additional upper disc is detachably fastened in the milling chamber such that the additional flow of the compressed fluid passes from the volume outside of the milling chamber through said permeable central passage and through one circular gap of said at least one circular gap radially towards the side wall of the milling chamber.

3. The vortex mill as defined in claim 1, in which the upper disc is provided with a gas permeable section having a plurality of through going openings such that the additional flow of the compressed fluid passes from the volume outside of the milling chamber through said gas permeable section and through one circular gap of said at least one circular gap radially towards the side wall of the milling chamber.

4. A method of vortex milling in a vortex mill as defined in claim 1, for comminuting of a raw particulate material, said method comprises:

supply of a flow of compressed working fluid to the milling chamber, said flow being directed tangentially with respect to said side wall of the milling chamber to create a vortex flow therein, supplying the raw particulate material to the milling chamber through said feeding tube and comminuting the raw particulate material in the milling chamber, discharging the comminuted material from the discharge collector, wherein said method further comprises arranging an additional fluid flow within the milling chamber wherein said additional fluid flow is adjacent with said lower and/or upper disc of the milling chamber and is directed radially from said center towards said side wall of the milling chamber.

5. The method of claim 4 further comprising arranging of an additional fluid flow within the milling chamber wherein said additional fluid flow is directed radially from said center of the milling chamber towards said side wall of the milling chamber and is adjacent to upper and/or lower disc of milling chamber, wherein a flow rate of the additional flow does not exceed 16% of a flow rate of the working fluid tangentially supplied through said at least one nozzle.

* * * * *